US005614997A

United States Patent [19]

Marumoto

[11] Patent Number: 5,614,997

[45] Date of Patent: Mar. 25, 1997

[54] TRANSFER DEVICE CONFIGURATION IN AN IMAGE-REPRODUCING STATION

[75] Inventor: Takeshi Marumoto, Osaka, Japan

[73] Assignee: Mita Industrial Co., Ltd., Osaka, Japan

[21] Appl. No.: 586,942

[22] Filed: Jan. 3, 1996

[30] Foreign Application Priority Data

Jan. 10, 1995 [JP] Japan ..... 7-002133

[51] Int. Cl.[6] ..... G03G 15/14

[52] U.S. Cl. ..... 399/121; 399/125; 399/315

[58] Field of Search ..... 355/271, 273, 355/274, 200, 215, 219, 221; 361/221, 222, 212, 214

[56] References Cited

U.S. PATENT DOCUMENTS

| | | | |
|---|---|---|---|
| 4,466,729 | 8/1984 | Iwata | 355/274 X |
| 5,175,589 | 12/1992 | Kimura | 355/271 |
| 5,233,393 | 8/1993 | Yoshida et al. | 355/271 |
| 5,479,239 | 12/1995 | Ishida et al. | 355/200 |
| 5,502,554 | 6/1996 | Hayashi et al. | 355/271 |

FOREIGN PATENT DOCUMENTS

| | | | |
|---|---|---|---|
| 2-163776 | 6/1990 | Japan | 355/271 |

*Primary Examiner*—Shuk Yin Lee

*Attorney, Agent, or Firm*—Shinyu Office of Patent Attorneys

[57] ABSTRACT

A configuration is provided for a pair of sheet-feeding registration rollers, a transfer device, and an image-forming photo-sensitive drum in an image reproducing apparatus particularly of the clamshell-type construction. The transfer device has a sheet-charging discharge wire for transferring a toner-developed image on the photo-sensitive drum to a copy sheet. A case for the transfer device includes a synthetic-resin housing which retains the discharge wire and is fitted into a shield frame. The shield frame is configured together with at least one bracing spring to constitute a positioning mechanism for maintaining a predetermined parallel spacing lengthwise between the discharge wire and the cylindrical surface of the photo-sensitive drum, the positioning mechanism therein elastically abutting specially formed lengthwise ends of the shield frame against either of lower ends of a housing containing the photo-sensitive drum. The upstream end of the transfer device case is configured to be freely pivotal about an axis of the lower of the registration rollers.

27 Claims, 6 Drawing Sheets

TRANSFER DEVICE CONFIGURATION IN AN IMAGE-REPRODUCING STATION

BACKGROUND OF THE INVENTION

1. Technical Field

The present invention relates to transfer devices in image reproducing apparatus. In particular the invention relates to the configuration in clamshell-type image reproducing devices in which the transfer device, the image reproducing element on which toner images are developed, and the registration rollers which transport sheets to the image reproducing element at a predetermined timing are positioned with respect to one another.

2. Description of Related Art

In xerographic photocopying machines, for example, wherein the surface of a photosensitive drum is exposed in correspondence with an original to retain a latent image subsequently developed with toner, transfer devices transfer the toner image on to a sheet brought in contact with the drum. These transfer devices generally are mounted in a rectangular trough-like shield frame. The shield frame is oriented along the axial direction of, and open for discharge exposure toward, the photo-sensitive drum. A discharge wire is disposed lengthwise within the shield frame, and insulating blocks of a pair supporting either end of the discharge wire are located at opposite ends lengthwise of the shield frame. In transfer devices of this type, a high voltage is applied to the discharge wire, producing an image-transferring corona discharge on the reverse of the sheet. Consequently, the toner image superficially retained on the drum is transferred onto the obverse side of the sheet.

With regard to photocopiers, the so-called clamshell type is known, wherein the machine body is split into an upper section which can be opened and closed freely on a lower section. In the clamshell photocopier, the photosensitive drum is located in the upper body section, and the transfer device is located in the lower body section. The end of the transfer device upstream in the direction of sheet flow is supported so as to be freely pivotal on a portion of a frame of the machine body. Further, the underside of the shield frame is urged toward the photo-sensitive drum by means of a spring.

The construction herein is such that with the upper body section closed onto the lower body section, the relative positions of the photo-sensitive drum and the transfer device are determined by abutment between a housing of the drum and a portion of the transfer device. A predetermined gap is thus maintained between the photo-sensitive drum surface and the discharge wire of the transfer device.

Sheet registration rollers in this sort of photocopier configuration are provided upstream of the photo-sensitive drum in the direction of copy paper supply, wherein the transfer device supported to be freely pivotal is downstream of the registration rollers. The distance between the fulcrum on which transfer device pivots and the discharge wire is consequently short.

Therefore, should there be dimensional aberration in the contacting portions between the transfer device and the photo-sensitive drum, owing, for example, to warp in manufacture or transport of the machine/components, wear, component replacement, or slippage in the joint between the upper and lower body sections, the angles among the registration rollers, the photo-sensitive drum, and transfer device discharge wire when they are in installation will be greatly displaced from initial settings. In consequence, the spacing between the surface of the photo-sensitive drum and the discharge wire cannot be accurately maintained.

Moreover, for separating the transferred-image bearing copy sheet from electrostatic attraction to the photo-sensitive drum, in some instances charge-removing needles are provided in the transfer device further downstream in the sheet flow direction from the discharge wire. Herein, it is also necessary to control accurately the distance between the charge-removing needles and the surface of the photo-sensitive drum. On the other hand, there is the problem that not being able to make the distance between the above-mentioned transfer device pivoting fulcrum and the charge-removing needles very extensive, even a slight dimensional aberration greatly thwarts accuracy.

In order to resolve these kinds of problems, it would do to lengthen the distance between the pivoting fulcrum and the abutment portions of the photo-sensitive drum and the transfer device serving to determine their relative positioning. The presence of registration rollers upstream in the sheet flow direction, however, limits the extent to which the fulcrum could be shifted in the upstream sheet-flow direction. Yet if the fulcrum were to be relocated downstream, this would separate both the discharge wire and the charge-removing needles away from the photo-sensitive drum, disabling effective functioning. In particular with compact photocopiers, since the diameter of the photo-sensitive drum is small, there are limitations to the position in which the transfer device can be located, such that the foregoing problems are even greater.

Furthermore, wherein a paper dust removing element which presses against the surface of the registration rollers is provided upstream of the transfer device, the paper dust removing element must be maintained at constant and sufficient pressure against the registration rollers. In configuring the transfer device accordingly, it is necessary to control very carefully the dimensions of that portion of the transfer device which supports the paper dust removing element, as well as the dimensions of the transfer device itself. This is extremely difficult.

SUMMARY OF THE INVENTION

An object of the present invention is to enable the distance between the image reproducing element, and the discharge wire as a sheet-charging member together with the charge-removing needles to be easily set to a high degree of accuracy in image reproducing apparatus of the clamshell-type configuration.

A further object is to simplify the structure of the support portions of the transfer device.

A still further object of the invention is to make it such that the paper dust removal member always abuts satisfactorily on the registration rollers.

In one aspect of the present invention, an image reproducing device includes a frame, an image reproducing element supported within the frame, a paper supply device supported in the frame, upper and lower registration rollers supported in the frame upstream of the image reproducing element and a transfer device disposed between the paper supply device and the image reproducing element. The transfer device includes a case positioned within the frame adjacent to the image reproducing element and configured to pivot about a rotation axis of the lower registration roller. A discharge wire as a sheet-charging member is supported within the case and extends along a portion of the case. A positioning mechanism is connected to the case and maintains a predetermined gap between the image reproducing element and the discharge wire.

Preferably, the positioning mechanism includes a contact part formed in the case, the contact part being configured to contact a portion of a drum housing, the drum housing retaining the image reproducing element. The positioning mechanism further includes a spring member which urges the case toward the image reproducing element and the drum housing.

Preferably, the frame includes a lower body section which supports the transfer device and an upper body section hinged to the lower body section, the upper body section supporting the image reproducing element and the upper body section configured to freely open and close with respect to the lower body section.

Preferably, the case is formed with a discharge opening on one side facing the image reproducing element. The case further comprises a shield frame and a housing, the shield frame at least partially surrounding the discharge wire, and the housing supporting opposite ends of the discharge wire.

Preferably, the housing further comprises a pair of insulating blocks and a connector part, the connector part extending between the insulating blocks, the connector part and the insulating blocks formed integrally as a single element, the insulating blocks supporting the discharge wire, the connector part positioned downstream of portions of the shield frame, and the housing supported on other portions of the shield frame.

Preferably, the connector part is fitted with a charge-removing member that extends lengthwise adjacent to the image reproducing element.

Preferably, the case further comprises a copy sheet transport guide member detachably connected to the connector part, and the charge-removing member is sandwiched between the connector part and the guide member.

Preferably, the case is configured to support a paper dust removal member such that the paper dust removal member contacts with a surface of the lower registration roller, and the paper dust removal member extends lengthwise along the axis of the lower registration roller.

Preferably, the shield frame is configured to support a paper dust removal member such that the paper dust removal member contacts a surface of the lower registration roller, and the paper dust removal member extends lengthwise along the axis of the lower registration roller.

In another aspect of the present invention, an image reproducing device includes a lower body section, and an upper body section hinged to the lower body section to freely open and close freely with respect to the lower body section. The image reproducing device further includes: an image data scanning means in the upper body section; an image forming part having a photo-sensitive drum supported in the upper body section; upper and lower registration rollers supported in the lower body section upstream of the image-forming part; a transfer device body supported in the lower body section downstream of the upper and lower registration rollers, the transfer device body having a discharge wire positioned adjacent to the photo-sensitive drum and the transfer device body being supported in the lower body section for pivotal movement about the lower registration roller; a positioning mechanism located on the transfer device body downstream from the registration rollers, the positioning mechanism configured to maintain a predetermined gap between the transfer device body and the photo-sensitive drum; and a fixing device located in the lower body section downstream of the transfer device body.

Accordingly, a toner image developed from a latent image retained superficially on the surface of the image reproducing element is transferred to the copy sheet fed by the pair of registration rollers. In this transfer device, one end of the case against which the discharge wire is disposed is supported so as to be freely pivotable on the axle of on one roller of the registration roller pair. The other end of the case is positioned by means of the positioning mechanism, and in this way the gap between the image reproducing member and the discharge wire is maintained at a specific distance.

Here, although the case is generally located in a narrow space which can be opposite the image reproducing element and moreover downstream of the pair of registration rollers, one end of the case is supported so as to freely rotate on the axle of one of the registration rollers, so that the distance between the pivoting center and the discharge wire is relatively large by comparison to conventional configurations. As a result even if dimensional aberrations occur in the positioning mechanism at the other end, the angular deviation is small, and variation in the gap between the image reproducing element and the discharge wire is relatively small by comparison with conventional configurations. Furthermore, since there is no need to provide a separate case supporter, the structure is simple.

Moreover, the other end of the case is braced against the image reproducing element, and the contact part formed at one end of the case is in contact with part of the image reproducing element, and the gap between the two is maintained at a specific distance. As a result it is possible to maintain the gap between the discharge wire and the image reproducing element at a specific distance with a simple structure.

Further, the body of the image forming device is comprised of a lower body section which supports the transfer device and an upper body section which supports the image reproducing element so as to freely open and close with respect to the lower body section, so that with the closing of the upper body section the image reproducing element and the case come into contact, and both are thereby positioned.

Yet further, the case is formed from the shield frame and the housing, and the shield frame is pivotal about the axle of one of the pair of registration rollers. Furthermore both ends of the discharge wire are supported by the housing.

Further still, the housing which comprises the case is comprised of a pair of insulating blocks and a connector formed integrally with the pair of insulating blocks, and the discharge wire is disposed between the pair of insulating blocks. Herein the structure is simple.

Moreover, since a charge-removing member for separating the copy sheet from the image reproducing element is located on said connector, it is possible to set the gap between the image reproducing element and the charge-removing member and the gap between the discharge wire and the charge-removing member with a high degree of accuracy.

Furthermore, the sheet transport guide member is attached so as to be freely detachable on the connector, and after image transfer the sheet is fed downstream guided by this guide member. Since it is fixed between the connector and the guide member, the charge-removing member is attachable through a simple structure.

Further, the paper dust removal member is in contact with the surface of the roller on the transfer device side of the registration rollers, and removes foreign matter such as paper dust, etc. which adheres to the surface of the roller.

Still further, the paper dust removal member is fitted to the shield frame, so the paper dust removal member is, along with the shield frame, pivotal about one roller of the registration rollers. As a result even if there are dimensional aberrations in every component, the paper dust removal member will always be pressed against the registration roller satisfactorily.

Moreover, when the upper body section is closed onto the lower body section, the gap between the photo-sensitive drum and the discharge wire is set at a fixed gap by means of the positioning mechanism. Therein, in a transfer device body where the discharge wire is fitted, since one end is supported so as to be freely pivotal on the axle of the lower roller of the registration rollers, the distance between the pivoting center and the discharge wire is greater than conventionally. As a result, likewise as above, even if dimensional aberrations should occur in the positioning mechanism at the other end, the variation in the gap between the image reproducing element and the discharge wire will be less than with conventional configurations. Furthermore the structure is simple, as there is no need to provided a separate case supporter.

These and other objects, features, aspects and advantages of the present invention will become more fully apparent from the following detailed description of the present invention when taken in conjunction with the accompanying drawings, where like reference numerals denote corresponding parts throughout, in which:

DETAILED DESCRIPTION OF THE PREFERRED EMBODIMENTS

Figure 1:
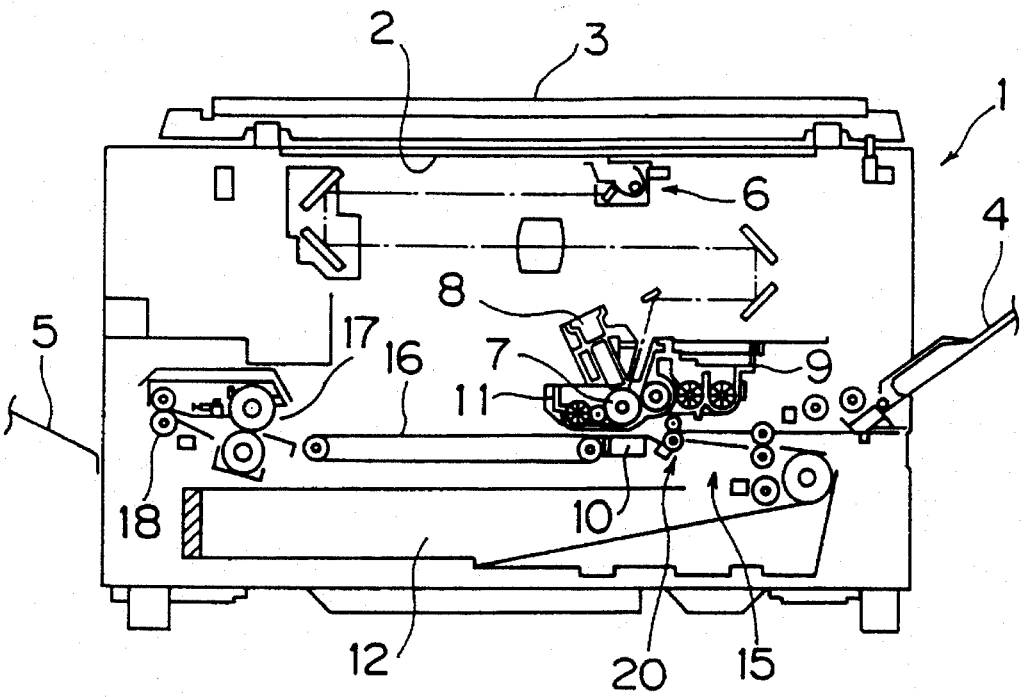
FIG. 1 is a schematic elevational section view of a clamshell-type photocopier in accordance with one embodiment of the present invention.
Figure 2:
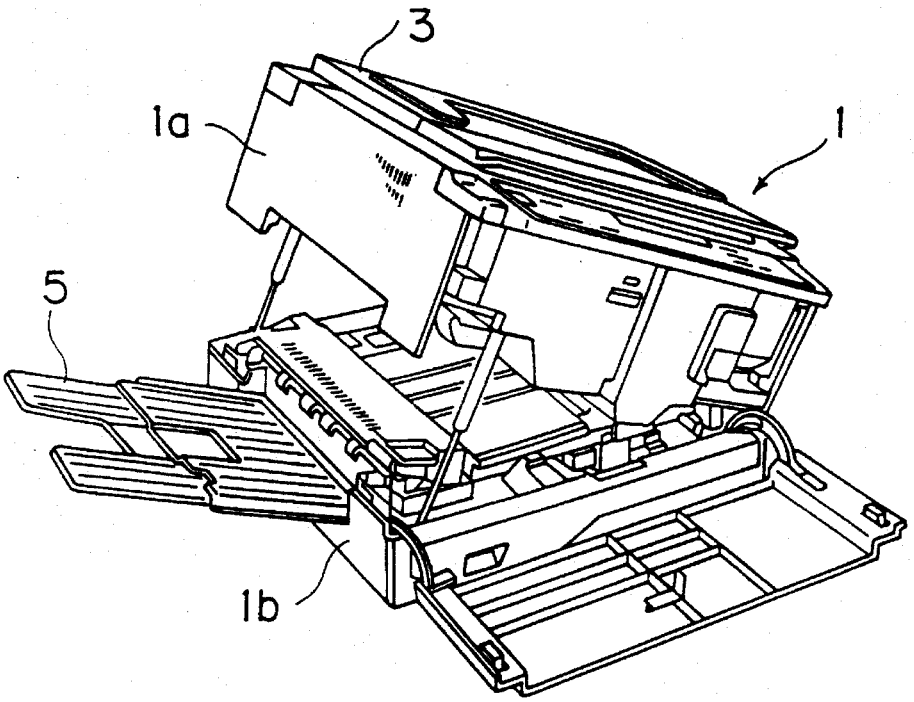
FIG. 2 is an oblique view the photocopier depicted in FIG. 1, showing the photocopier in an opened state.

FIGS. 1 and 2 depict a clamshell-type photocopier in which a transfer device in accordance with an embodiment of the present invention is employed. In the figures, a document table 2 is shown fixed in the upper surface of photocopier 1, where a document holder 3 is hinged for opening off and closing onto the top of the document platform 2. On the right-hand side of photocopier 1 in the figure a copy sheet tray for manual supply is fitted, and on the left-hand side thereof in the figure a discharge tray 5 is fitted, into which processed copy sheets are sent.

Exposure device 6 for reading document originals is provided in the upper interior of the photocopier 1. A photo-sensitive drum 7 for superficially developing a toner image in correspondence with exposure of a document original is disposed in the middle of the photocopier 1 interior. Further, a main charging device 8, a developer 9, a transfer device 10 and a cleaning device 11 are disposed surrounding photo-sensitive drum 7, and together with the photo-sensitive drum 7 form an image reproducing station. Also, a copy sheet feed cassette 12 is provided in the lower interior of the photocopier 1.

Figure 3:
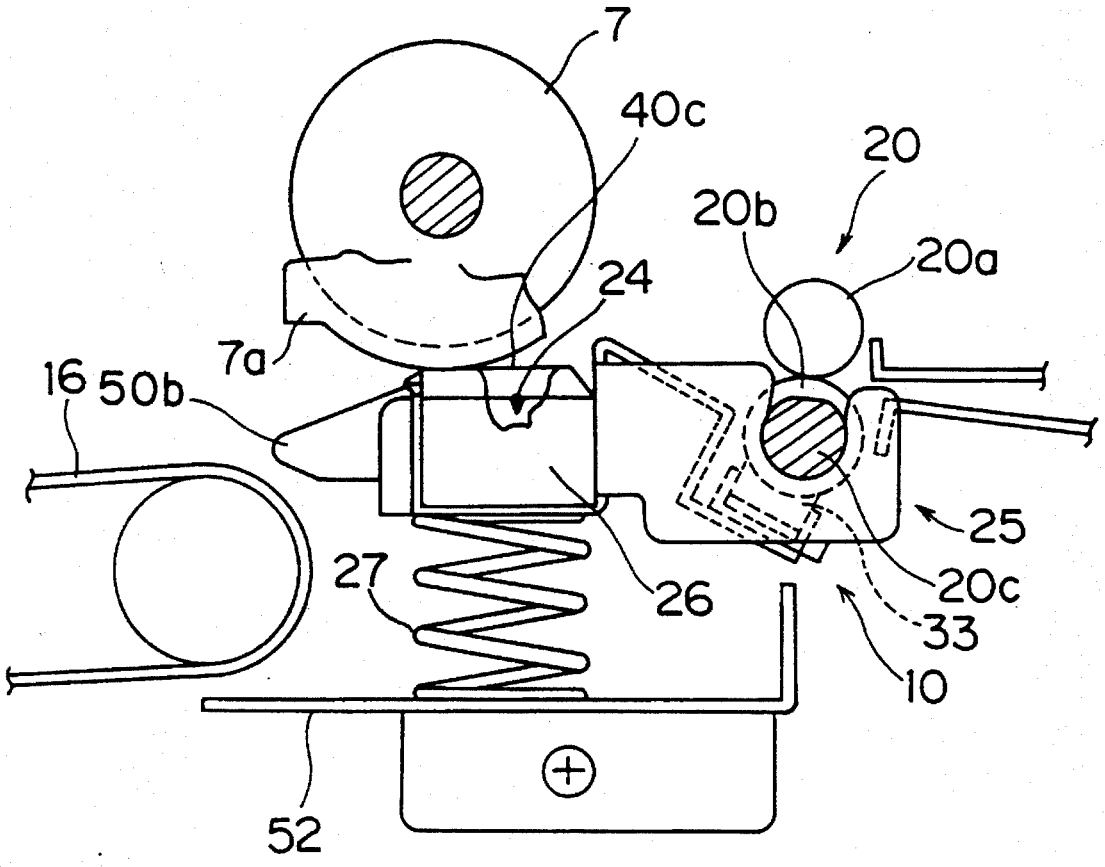
FIG. 3 is a part cut-away, part section, elevational view of a transfer device portion, shown in a slightly enlarged scale, of the photocopier depicted in FIG. 1.

Sheet supply transport device 15 for transporting copy sheets to the transfer device 10 is provided between manual sheet supply tray 4 and sheet supply cassette 12, and the image reproducing station including the photo-sensitive drum 7, etc. Furthermore, between the image reproducing station and the discharge tray 5, a sheet discharging device 16, a fixing unit 17 and discharging rollers 18 are located. Registration rollers 20 are further provided, disposed adjacent the photo-sensitive drum 7 on its upstream in the direction of copy sheet flow through the photocopier 1. Registration rollers 20, shown enlarged in FIG. 3, are a pair consisting of an upper roller **20*a* and a lower roller 20*b*. The registration rollers 20 feed to photo-sensitive drum 7 sheets brought by the sheet supply transport device 15** at a stipulated timing.

Photocopier 1 is composed of an upper body section **1*a* and a lower body section 1*b*. Upper body section 1*a* is connected to lower body section 1*b* by means of a hinge (not shown, although it is to the right in FIG. 2) on which it is freely pivotal. Accordingly, upper body section 1*a* can be opened by pivoting it upwards with respect to lower body section 1*b*, as shown in FIG. 2. Herein all components located above photo-sensitive drum 7 are supported within the upper body section 1*a*, and components such as the transfer device 10 and the fixing unit 17 are supported within the lower body section 1*b***.

Transfer device 10 will now be described in detail.

The principal components of transfer device 10, shown in position below photo-sensitive drum 7 in FIG. 3, are a sheet-charging discharge wire (or sheet-charging member) 24, disposed to lie in the axial direction of photo-sensitive drum 7, metal shield fame 25, housing 26 fitted into this shield frame 25, and bracing spring 27.

Figure 4:
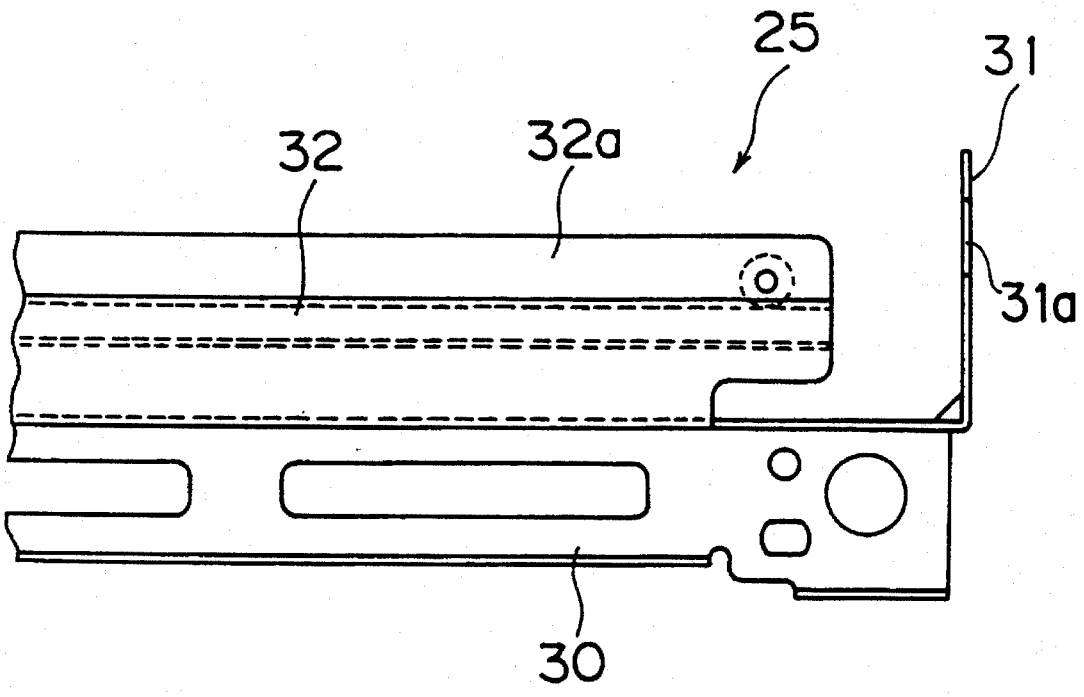
FIG. 4 is a fragmentary plan view of a shield frame of the transfer device depicted in FIG. 3, shown removed from the transfer device.
Figure 5:
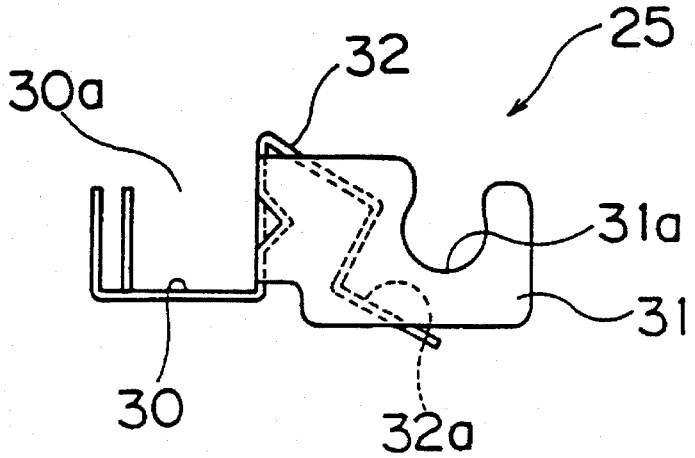
FIG. 5 is an end view of the shield frame depicted in FIG. 4, shown removed from the transfer device depicted in FIG. 3.
Figure 6:
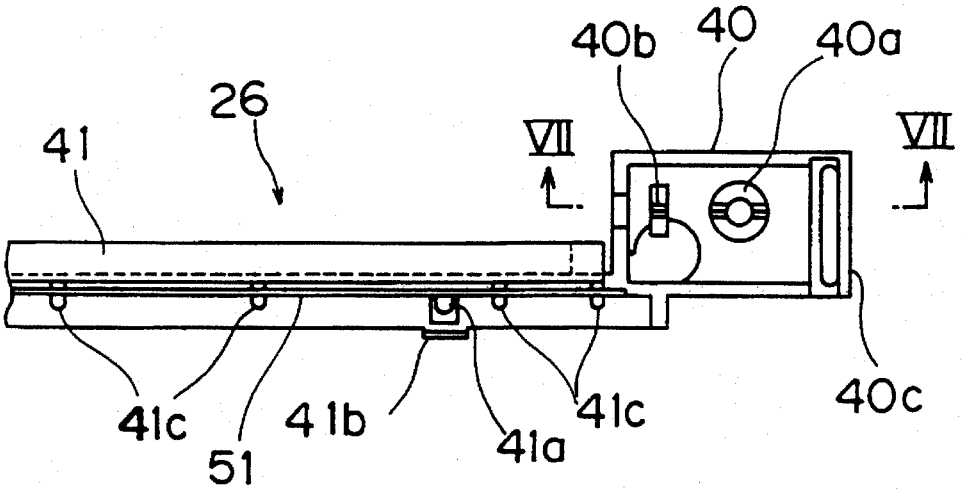
FIG. 6 is a fragmentary plan view of a housing associated with the transfer device depicted in FIG. 3, shown removed from the transfer device.
Figure 7:
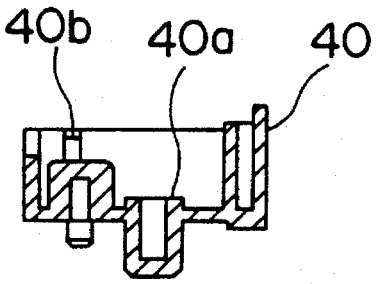
FIG. 7 is a cross section taken through the line VII—VII in FIG. 6 viewed in the direction of the arrows.
Figure 8:
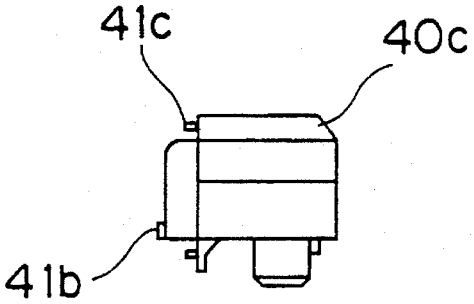
FIG. 8 is an end view of the housing depicted in FIGS. 6 and 7.
Figure 9:
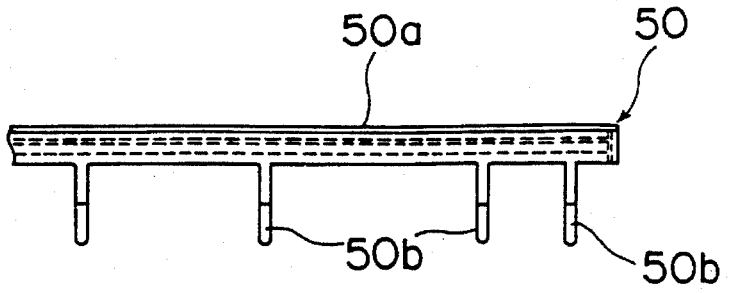
FIG. 9 is a fragmentary plan view, with some features shown in phantom, of a guide member associated with the transfer device depicted in FIG. 3, the guide member shown removed from the transfer device.

Shield frame 25, as shown in FIGS. 3 through 5, consists of a housing mount 30, extending in a direction along the rotational axis of the photo-sensitive drum 7; perpendicular to the sheet flow direction; supports 31 of a pair provided at either end lengthwise of the shield frame 25, extending upstream in the sheet flow direction; and paper dust removing element mount 32, formed projecting down from the top of an upstream wall of housing mount 30, also extending upstream with respect to the sheet flow direction.

Housing mount 30 is formed U-shaped in cross-section so as to surround discharge wire 24, opening upward, (as indicated by reference mark 30*a*), toward the photo-sensitive drum for discharge exposure by the discharge wire 24. An arched engagement notch 31*a* is formed in either support 31, and, as shown in FIG. 3, the notch 31*a* is supported to be freely pivotal about axle 20*c* of the lower roller 20*b* of the pair of registration rollers 20. Furthermore, a fitting portion 32*a* is formed along the lower (upstream) end of paper dust removing element mount 32 at a predetermined distance from lower roller 2*b*. The fitting portion 32*a* moreover, forms a mounting surface substantially parallel to a plane tangent with the lower roller 20*b*. A paper dust removing element 33 (FIG. 3), composed of felt or the like, is fitted to the fitting portion 32*a*. Paper dust removing element 33 is, in the above-described configuration, thus pressed against the circumferential surface of lower roller 20*b*.

Housing 26 is a modular element made of a synthetic resin and, as shown in FIG. 3 and FIGS. 6 through 8, when mounted extends lengthwise along the axis of photo-sensitive drum 7. Insulating blocks 40 of a pair are formed at respective lengthwise ends of housing 26, joined by shank (or connector) 41 formed integrally between the insulating blocks 40.

Each insulating block 40 includes a mount 40*a* to which respective ends of the discharge wire 24 are connected, and supports 40*b* for supporting the discharge wire 24 before the mounts 40*a*. (Note that the discharge wire 24 is only indicated, endwise, in FIG. 3; whereas for clarity in FIGS. 6, 7, 13 and 14 the discharge wire 24 is not depicted.)

Further, along the top end of an end wall 40*c* on the outermost side of insulating block 40, a flat contact portion is formed. As shown in FIG. 3, lower end of drum housing 7*a* arranged on either end of photo-sensitive drum 7 is abuttable on the top edge of the end wall 40*c*. Shank 41 is formed integrally as an extension of the insulating block 40 end wall downstream in the sheet flow direction. Shank 41 is provided with a plurality of pegs 41*a* (only one is shown in location in FIG. 6, while two appear in FIGS. 13 and 14) disposed at predetermined lengthwise spacings. Further, a channel 41*b* is formed beneath each peg 41*a*. Moreover, along the downstream edge of the top of shank 41 a plurality of sheet guide nibs 41*c* for guiding sheets in transport through the transfer device is formed at predetermined lengthwise spacings.

Figure 10:
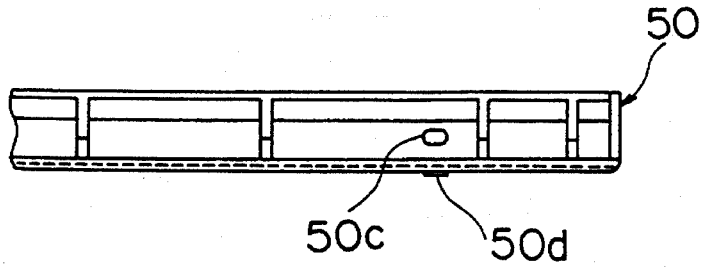
FIG. 10 is a front elevational view of the guide member depicted in FIG. 9.
Figure 11:
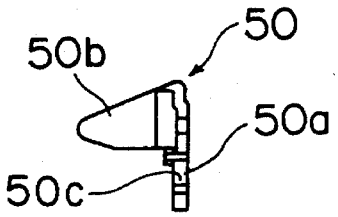
FIG. 11 is an end view of the guide member depicted in FIGS. 9 and 10.

A sheet transport guiding element 50, depicted in FIGS. 9 through 14, attaches to the lateral surface of shank 41 downstream in the sheet flow direction. The guiding element 50 is composed of a wall 50*a* which contacts said lateral surface of shank 41, and guide projections 50*b*. The guide projections 50*b* extend in a downward slope from the upper edge of wall 50*a*, in a substantially triangular form in cross-section as shown in the FIG. 11 view. A plurality of the guide projections 50*b* are provided at predetermined lengthwise spacings. Slots 50*c* are provided in the middle vertically of the wall 50*a* of the sheet transport guiding element 50. FIG. 10 shows locator bosses 50*d* protruding slightly from the bottom of guiding element 50 below the slots 50*c*. Guiding element 50 is fitted to shank 41 by engagement of the pegs 41*a* with the slots 50*c*, and by engagement of the locator bosses 50*d* with the channels 41*b* at the foot of the adjacent lateral surface of shank 41.

Figure 12:
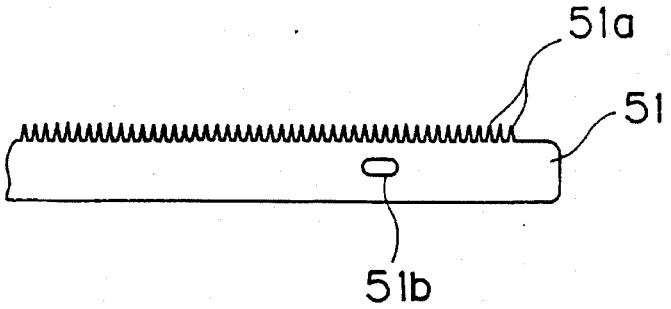
FIG. 12 is a fragmentary front elevational view of a charge-removing member associated with the transfer device depicted in FIG. 3, the charge-removing member shown removed from the transfer device.
Figure 13:
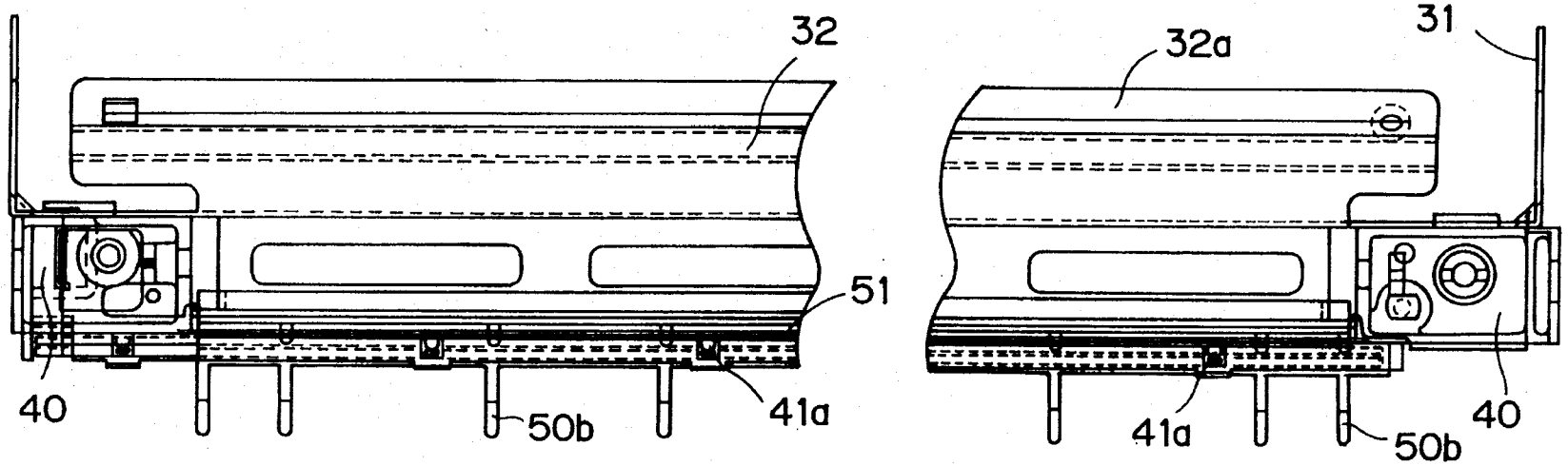
FIG. 13 is a fragmentary plan view of the transfer device depicted in FIG. 3, shown removed from the clam-shell type photocopier, shown with the shield frame, the housing, the charge-removing member and transport guide member fully assembled.
Figure 14:
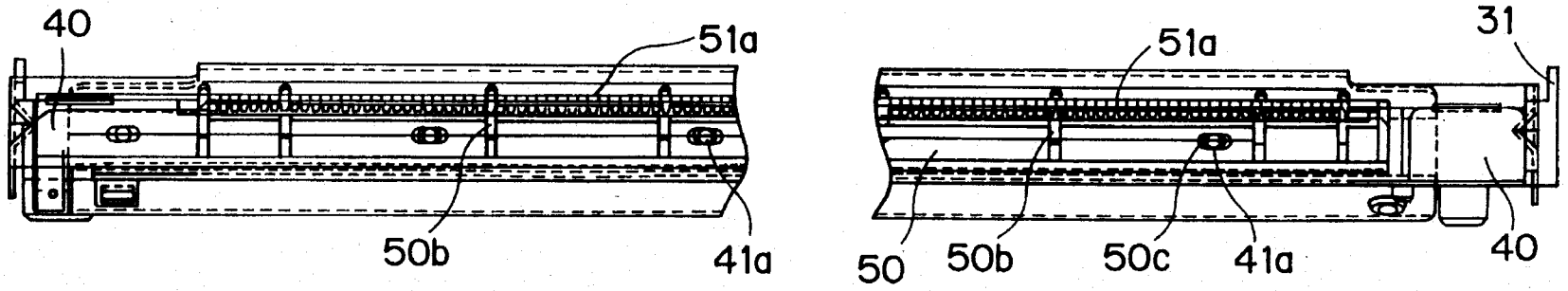
FIG. 14 is a fragmentary front view of the transfer device depicted in FIG. 13, viewed in the direction of the arrow XIV.

In the fitting of guiding element 50 to shank 41, a charge-removing element 51, depicted in FIG. 12, is meanwhile sandwiched therebetween. Charge-removing element 51 is a metal plate element extends in the axial direction of the photo-sensitive drum 7. A plurality of needle-like teeth 51*a* at predetermined lengthwise spacings is formed projecting upward from the top edge of the charge-removing element 51. Moreover a plurality of slots 51*b* is formed in the middle vertically of the charge-removing element 51, for engagement with the pegs 41*a* of shank 41.

Shield frame 25, housing 26 and sheet transport guiding element 50 of the above-described configuration are freely pivotal about the center of the axle 20*c* on which lower roller 20*b* of the registration rollers 20 is rotational. Bracing spring 27 is provided between a transfer device support frame 52 and the bottom surface of housing mount 30 of shield frame 25. Bracing spring 27 thus braces the downstream ends of shield frame 25 in the sheet flow direction against the adjacent ends of the photo-sensitive drum 7.

Next, an explanation outlining the operation of the photocopier will be given.

An original document is placed on manuscript platform 2, and when the photocopy key is depressed a copy sheet is fed from sheet supply cassette 12 for example, and sent on to registration rollers 20 via sheet supply transport device 15. At the same time the image data is read from the document by exposure device 6, and an electrostatic latent image is formed superficially on photo-sensitive drum 7 in correspondence with the document image data. This electrostatic latent image is developed by developing device 9 to form a toner image on the surface of photo-sensitive drum 7. Registration rollers 20 feed the copy sheet to the photo-sensitive drum 7 in synchrony with the rotation of photo-sensitive drum 7. When a sheet is brought between photo-sensitive drum 7 and transfer device 10, a high voltage is applied to the discharge wire 24 of transfer device 10, by which means a corona discharge is generated on the rear surface of the sheet, inducing transfer of the toner image on the surface of photo-sensitive drum 7 to the sheet. At the same time an AC voltage is applied to charge-removing element 51, and by this means the electrical charge on the sheet is removed to separate the sheet from photo-sensitive drum 7. The sheet on which the toner image has been transferred is sent to fixing unit 17 by sheet discharging device 16. In fixing unit 17 the toner image is fixed onto the sheet, and the copy-processed sheet is then discharged into discharge tray 5 by means of the discharging rollers 18.

Meanwhile, a predetermined gap is maintained between photo-sensitive drum 7 and transfer device 10 by the contact between the ends of drum housing 7*a* and the contact portion of the end walls 40*c* of housing 26.

When upper body section 1*a* is opened in order to deal with a jam or the like, the machine components including the photo-sensitive drum 7, etc. are turned upwards together with upper body section 1*a*. Therein, transfer device 10 is braced upwards by means of spring 27, and turns upwards around the axle 20*c* of lower roller 20*b*. Meanwhile, when upper body section 1*a* is closed, either lower end of drum housing 7*a* press on the contact portion of the end walls 40*c* of housing 26 of transfer device 10, and thereby the transfer device 10 is turned downwards against the elastic resistance of spring 27. Thus the gap between the surface of photo-sensitive drum 7 and discharge wire 24 is maintained at a fixed distance.

With a configuration in accordance with the afore-described embodiment, since the shield frame 25 of transfer device 10 pivots centrally on the axle 20*c* of lower roller 20*b* of the registration rollers 20, a relatively long distance between the pivoting center and discharge wire 24 can be secured. As a result, even with dimensional aberration in the contact portions on the ends of photo-sensitive drum 7 and housing 26, there will be relatively little angular deviation. Thus changes in the gap between the surface of the photo-sensitive drum and discharge wire 24 will be relatively few. Moreover, since the insulating blocks 40 to which discharge wire 24 is fitted and the shank 41 to which the charge-removing element 51 is fitted are formed integrally, accumulation of component manufacturing aberrations is eliminated, the gap between discharge wire 24 and charge-removing element 51 can be maintained with a high degree of accuracy, and even with both disposed within the same narrow space it is possible to avoid adverse effects on image transfer due to the charge-removing element 51. Moreover the gap between the surface of the photo-sensitive drum 7 and the charge-removing element 51 can be set with a high degree of accuracy.

In addition, the pivotal center of paper dust removal member 33 is about the axle of lower roller 20*b*, so that even if there are dimensional aberrations in all the parts it is always in the same state of contact.

In the foregoing embodiment the invention has been described as applied to a photocopier, but it may be also be applied in the same way to facsimile devices, printers, etc.

With the transfer device of the invention as described above, since one end of the case or body of the transfer device in which the discharge wire is disposed is supported so as to be freely pivotal on the axle of one roller of the pair of registration rollers, the distance between the pivoting center and the discharge wire is greater than is conventional. As a result, even if dimensional aberrations occur in the positioning mechanism at the other end, the variation in the distance between the image reproducing element and the discharge wire is smaller than in conventional configurations. Furthermore, as there is no need to provide a separate support for the case, the structure is simple.

Moreover, the other end of the transfer device case is braced toward the image reproducing element, and in addition, since the case and the image reproducing element are positioned so as to be in contact with one another, the gap between the discharge wire and the image reproducing element can be maintained at a specific interval through a simple structure.

Furthermore, the housing composing the case includes a pair of insulating blocks, and a connector formed integrally with the pair of insulating blocks, so the structure is simple.

In addition, since a charge-removing element for separating the sheet from the image reproducing element is located on the connector of the case, it is possible to set the distance between the discharge wire and the charge-removing element with a high degree of accuracy and it is possible to suppress the adverse effect of the high voltage applied to the charge-removing element on the image.

Furthermore, since the charge-removing element is fixed between the connector and the transport guide member, the charge-removing element may be easily fitted.

Moreover, since a paper dust removal element is provided, it is possible to remove foreign matter such as paper dust adhering to the surface of the registration rollers.

Furthermore, since the paper dust removal member is pivotal together with the shield frame about one of the rollers of the pair of registration rollers, even if dimensional aberrations should occur in the positioning mechanism, etc., the paper dust removal member will always remain satisfactorily pressed against the registration roller.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An image reproducing device comprising:

a frame;

an image reproducing element supported within a portion of said frame wherein a paper transport path is at least partially defined within said frame such that movement of paper extends from a paper supply tray to a paper discharge tray, both of said trays supported on said frame;

upper and lower registration rollers supported in a portion of said frame upstream of said image reproducing element with respect to movement of paper along said transport path; and a transfer device disposed approximately between said registration rollers and said image reproducing element, said transfer device including:

a case configured to be pivotal about a rotational axis of one of said registration rollers, and positionable within said frame to be opposed to said image reproducing element;

a sheet-charging member supported within said case and extending along a portion of said case;

a positioning mechanism connected to said case to maintain a predetermined gap between said image reproducing element and said sheet-charging member; and a charge removing member connected to said case, said charge removing member having a plurality of projections and extending lengthwise adjacent to said image reproducing element.

2. The image reproducing device as in claim 1, wherein said positioning mechanism comprises:

a contact part formed in said case, configured to contact a portion of a drum housing connected to said image reproducing element; and an urging member which urges said case toward said image reproducing element and said drum housing.

3. The image reproducing device as in claim 2, wherein said frame comprises:

a lower body section which supports said transfer device; and an upper body section hinged to said lower body section, said upper body section supporting said image reproducing element and said upper body section configured to freely open and close with respect to said lower body section and said portion of said drum housing includes an arcuate shaped surface which contacts said contact part when said upper body section is in a closed position.

4. The image reproducing device as in claim 2, wherein said frame comprises:

a lower body section which supports said transfer device; and an upper body section hinged to said lower body section, said upper body section supporting said image reproducing element and said upper body section configured to freely open and close with respect to said lower body section.

5. The image reproducing device as in claim 1, wherein said case is formed with a discharge opening on one side facing said image reproducing element, said case further comprising a shield frame and a housing, said shield frame at least partially surrounding said sheet-charging member, and said housing supporting opposite ends of said sheet-charging member.

6. The image reproducing device as in claim 5, wherein said housing further comprises a pair of insulating blocks and a connector part, said connector part extending between said insulating blocks, said connector part and said insulating blocks formed integrally as a single element, said insulating blocks supporting said sheet-charging member, said connector part positioned downstream of portions of said shield frame with respect to movement of paper along said transport path, and said housing supported on other portions of said shield frame.

7. The image reproducing device as in claim 6, in which said connector part is fitted with said charge-removing member which extends lengthwise adjacent to said image reproducing element.

8. The image reproducing device as in claim 7, wherein said case further comprises a copy sheet transport guide member detachably connected to said connector part, and said charge-removing member being sandwiched between said connector part and said guide member.

9. The image reproducing device as in claim 1, wherein said case is configured to support a paper dust removal member such that said paper dust removal member contacts with a surface of said lower registration roller, and said paper dust removal member extends lengthwise along an axis of said lower registration roller.

10. The image reproducing device as in claim 5, in which said shield frame is configured to support a paper dust removal member such that said paper dust removal member contacts a surface of said lower registration roller, and said paper dust removal member extends lengthwise along an axis of said lower registration roller.

11. An image reproducing device comprising:

a frame;

an image reproducing element supported within a portion of said frame wherein a paper transport path is at least partially defined within said frame such that movement of paper extends from a paper supply tray to a paper discharge tray, both of said trays supported on said frame;

upper and lower registration rollers supported in a portion of said frame upstream of said image reproducing element with respect to movement of paper along said transport path; and a transfer device disposed approximately between said registration rollers and said image reproducing element, said transfer device including:

a case configured to be pivotal about a rotational axis of one of said registration rollers, and positionable within said frame to be opposed to said image reproducing element;

a sheet-charging member supported within said case and extending along a portion of said case;

a positioning mechanism connected to said case to maintain a predetermined gap between said image reproducing element and said sheet-charging member; and a paper dust removal member supported by said case, said paper dust removal member contacting a surface of said lower registration roller, and said paper dust removal member extends lengthwise along an axis of said lower registration roller.

12. The image reproducing device as in claim 11, wherein said positioning mechanism comprises:

a contact part formed in said case, configured to contact a portion of a drum housing connected to said image reproducing element; and an urging member which urges said case toward said image reproducing element and said drum housing.

13. The image reproducing device as in claim 12, wherein said frame comprises:

a lower body section which supports said transfer device; and an upper body section hinged to said lower body section, said upper body section supporting said image reproducing element and said upper body section configured to freely open and close with respect to said lower body section and said portion of said drum housing includes an arcuate shaped surface which contacts said contact part when said upper body section is in a closed position.

14. The image reproducing device as in claim 11, wherein said frame comprises:

a lower body section which supports said transfer device; and an upper body section hinged to said lower body section, said upper body section supporting said image reproducing element and said upper body section configured to freely open and close with respect to said lower body section.

15. The image reproducing device as in claim 11, wherein said case is formed with a discharge opening on one side facing said image reproducing element, said case further comprising a shield frame and a housing, said shield frame at least partially surrounding said sheet-charging member, and said housing supporting opposite ends of said sheet-charging member.

16. The image reproducing device as in claim 15, wherein said housing further comprises a pair of insulating blocks and a connector part, said connector part extending between said insulating blocks, said connector part and said insulating blocks formed integrally as a single element, said insulating blocks supporting said sheet-charging member, said connector part positioned downstream of portions of said shield frame with respect to movement of paper along said transport path, and said housing supported on other portions of said shield frame.

17. The image reproducing device as in claim 16, in which said connector part is fitted with a charge-removing member which extends lengthwise adjacent to said image reproducing element.

18. The image reproducing device as in claim 17, wherein said case further comprises a copy sheet transport guide member detachably connected to said connector part, and said charge-removing member being sandwiched between said connector part and said guide member.

19. The image reproducing device as in claim 15, in which said shield frame is configured to support said paper dust removal member.

20. An image reproducing device comprising:

a frame;

an image reproducing element supported within a portion of said frame wherein a paper transport path is at least partially defined within said frame such that movement of paper extends from a paper supply tray to a paper discharge tray, both of said trays supported on said frame;

upper and lower registration rollers supported in a portion of said frame upstream of said image reproducing element with respect to movement of paper along said transport path; and a transfer device disposed approximately between said registration rollers and said image reproducing element, said transfer device including:

a case having a shield frame and a housing, said case configured to be pivotal about a rotational axis of one of said registration rollers, and positionable within said frame to be opposed to said image reproducing element;

a sheet-charging member supported within said case and extending along a portion of said case; and a positioning mechanism connected to said case to maintain a predetermined gap between said image reproducing element and said sheet-charging member;

wherein said case is formed with a discharge opening on one side facing said image reproducing element, said shield frame at least partially surrounds said sheet-charging member, and said housing supports opposite ends of said sheet-charging member; and said housing further comprises a pair of insulating blocks and a connector part, said connector part extending between said insulating blocks, said connector part and said insulating blocks formed integrally as a single element, said insulating blocks supporting said sheet-charging member, said connector part positioned downstream of portions of said shield frame with respect to movement of paper along said transport path, and said housing supported on other portions of said shield frame.

21. The image reproducing device as in claim 20, wherein said positioning mechanism comprises:

a contact part formed in said case, configured to contact a portion of a drum housing connected to said image reproducing element; and an urging member which urges said case toward said image reproducing element and said drum housing.

22. The image reproducing device as in claim 21, wherein said frame comprises:

a lower body section which supports said transfer device; and an upper body section hinged to said lower body section, said upper body section supporting said image reproducing element and said upper body section configured to freely open and close with respect to said lower body section and said portion of said drum housing includes an arcuate shaped surface which contacts said contact part when said upper body section is in a closed position.

23. The image reproducing device as in claim 20, wherein said frame comprises:

a lower body section which supports said transfer device; and an upper body section hinged to said lower body section, said upper body section supporting said image reproducing element and said upper body section configured to freely open and close with respect to said lower body section.

24. The image reproducing device as in claim 22, in which said connector part is fitted with a charge-removing member which extends lengthwise adjacent to said image reproducing element.

25. The image reproducing device as in claim 24, wherein said case further comprises a copy sheet transport guide member detachably connected to said connector part, and said charge-removing member being sandwiched between said connector part and said guide member.

26. The image reproducing device as in claim 20, wherein said case is configured to support a paper dust removal member such that said paper dust removal member contacts with a surface of said lower registration roller, and said paper dust removal member extends lengthwise along an axis of said lower registration roller.

27. The image reproducing device as in claim 20, in which said shield frame is configured to support a paper dust removal member such that said paper dust removal member contacts a surface of said lower registration roller, and said paper dust removal member extends lengthwise along an axis of said lower registration roller.

* * * * *